US005547188A

United States Patent [19]

Dumontier et al.

[11] Patent Number: 5,547,188

[45] Date of Patent: Aug. 20, 1996

[54] SERIES OF GOLF CLUBS

[75] Inventors: Franck Dumontier, Vista, Calif.; Jean-Marc Guibaud, Annecy, France; Mike Peters, San Diego; Steven Brouillette, Vista, both of Calif.

[73] Assignee: Taylor Made Golf Company, Inc., Carlsbad, Calif.

[21] Appl. No.: 321,842

[22] Filed: Oct. 14, 1994

[30] Foreign Application Priority Data

Nov. 12, 1993 [FR] France ..... 93 13680

[51] Int. Cl.[6] ..... A63B 53/04

[52] U.S. Cl. ..... 473/287; 473/324

[58] Field of Search ..... 273/167 A, 174, 273/168, 169, 172, 173, 167 F, 167 G, 167 H, 167 J, 167 K, 77 A

[56] References Cited

U.S. PATENT DOCUMENTS

| | | | |
|---|---|---|---|
| D. 307,783 | 5/1990 | Iinuma | D21/214 |
| D. 310,254 | 8/1990 | Take et al. | D21/214 |
| D. 318,087 | 7/1991 | Helmstetter | D21/214 |
| D. 341,177 | 11/1993 | Yamada | D21/214 |
| D. 351,441 | 10/1994 | Iinuma et al. | D21/214 |
| 1,619,566 | 3/1927 | Crankshaw . | |
| 1,868,286 | 7/1932 | Grieve . | |
| 2,004,968 | 6/1935 | Young | 273/174 |
| 2,041,676 | 5/1936 | Gallagher | 273/77 |
| 2,201,638 | 5/1940 | Theibault, Sr. | 273/167 A |
| 3,815,921 | 6/1974 | Turner | 273/167 A |
| 4,671,513 | 6/1987 | Swanson | 273/167 A |
| 5,154,423 | 10/1992 | Antonious | 273/167 A |
| 5,240,252 | 8/1993 | Schmidt et al. | 273/167 A |
| 5,271,622 | 12/1993 | Rogerson | 273/174 |
| 5,280,923 | 1/1994 | Lu | 273/167 H |

FOREIGN PATENT DOCUMENTS

| | | | |
|---|---|---|---|
| 0532876 | 3/1993 | European Pat. Off. | A63B 53/04 |

OTHER PUBLICATIONS

Spalding Catalog "PRO GOLF", 1984, p. 20, Dynamiter metal wood.

Spalding Catalog "PRO GOLF", 1985, p. 21, Dynamiter metal wood.

*Primary Examiner*—Steven B. Wong

*Attorney, Agent, or Firm*—Greenblum & Bernstein P.L.C.

[57] ABSTRACT

A series of golf clubs, in which each head includes at least one outer median rib in relief with respect to a sole and substantially perpendicular to an attack edge, wherein the width of the rib decreases when the loft angle increases in this series.

22 Claims, 5 Drawing Sheets

SERIES OF GOLF CLUBS

BACKGROUND OF THE INVENTION

1. Field of the Invention

The present invention relates to the field of golf clubs used in practicing the sport of the same name.

More particularly, the invention relates to a series of golf clubs of which each head includes in particular at least one front face used to strike the ball, and one bottom face.

Still more particularly, the invention relates to a series of golf clubs in which certain characteristics of these faces evolve within this series.

2. Discussion of Background and Material Information

The game of golf consists of using a series of golf clubs to drive a ball into a hole located quite a distance from a starting point of the game.

In the great majority of cases, the golfer has to hit the ball several times along the fairway.

To that end, he will use different clubs, selected from the series he uses, whose characteristics tend to improve the playing quality.

The starting club, generally called a driver, makes it possible to drive the ball quite far away from a flat zone called the tee. The intermediate clubs, which are woods, wood-metal clubs, or irons, make it possible to come closer to the hole. Finally, the last clubs, called putters, are used in the immediate proximity of the hole, in a zone called the green.

Because of the various types of terrain encountered, except on the green, it becomes necessary to use clubs in which the inclination of the striking face is increasingly pronounced, the closer the player gets to the hole, since a preferential lofting of the ball must be assured. These various terrains, which may be high grass, dirt, sand or other kinds, present additional difficulties to the player.

These difficulties are more easily overcome if the head of the club presents reduced resistance to friction when the head passes over the ground in the course of the swing.

To that end, the prior art has proposed heads of golf clubs whose bottom face or sole has a reduced surface area in contact with the ground.

U.S. Pat. No. 5,240,252 to Callaway discloses the structure of a golf club head whose sole is hollowed out by concave lateral cavities.

U.S. Pat. No. 1,868,286 to Grieve and U.S. Pat. No. 1,619,566 to Crankshaw each show a golf club head sole in the form of the letter T, with one rib adjacent to the striking face and a central rib perpendicular to the first.

All these references relate to heads that touch the ground only with relief-type portions of their sole.

However, the various known heads do not enable assembling a series in which each head has a reduced area of contact with the ground while preserving good stability in addressing the ball.

SUMMARY OF THE INVENTION

An object of the present invention is to overcome this disadvantage by proposing a series of clubs in which each club head is adapted to the exigencies of particular localized terrain areas, by the choice of specific characteristics of the sole of a head with respect to the inclination of the driving face of the same head.

To that end, a series of golf clubs according to the invention, in which each club includes a hosel inscribed within a vertical plane P oriented perpendicular to a driving line and to which is joined a head that has a set of faces, of which at least one is a bottom face or sole intended to rest on the ground and at least one is a front face inclined by a loft angle a relative to the plane P, the intersection of the sole and the front face forming an attack edge, the sole including at least one outer median rib in relief with respect to the outer surface of the sole and substantially perpendicular to the attack edge, is characterized in that the width l1 of the rib decreases when the loft angle a increases within the series.

Advantageously, the sufficient width of the median rib enables better stability in addressing the ball compared with known heads, especially at the beginning of the series where the loft angle is slight.

On the other hand, this arrangement enables the median rib to guide the head when it is tangent to the ground. The resultant guidance has an advantage in that it avoids deviation of the head relative to the trajectory the golfer is seeking.

Another advantage is due to the fact that the width of the rib decreases when the loft angle increases, that is, when more-difficult terrain conditions require a greater loft angle to lift the ball. A stronger contact of the head of the club with the ground results; the reduction in width of the rib lessens the friction that impedes the golfer, but above the head then has a better capacity to penetrate the grass.

Another characteristic of the series of clubs according to the invention is that the sole includes an outer rib adjacent to the attack edge, positioned substantially perpendicular to the median rib.

A first advantage of such an arrangement is to prevent the club head from being driven in excessively deeply when it contacts the ground, due to the fact that the rib adjacent to the attack edge runs along this edge over a large portion of it.

A second advantage of this arrangement is that the attack edge is reinforced, and the impact resistance of the sole is improved.

Another advantage is that a correct placement of the head on addressing the ball is promoted; that is, the golfer is enabled to position the club better just before striking the ball.

Still another advantage is obtained when the median rib and the rib adjacent to the attack edge touch and are substantially equal in thickness, since this produces an effect of continuity in the swing where the head is not driven in very much, while being well guided by this median rib.

An additional arrangement according to the invention consists in that the median rib is extended with two branches on the side opposite the attack edge, and the directions of which form an angle other than zero between them.

The median rib is thus prolonged by a sort of arrow in relief on the sole; this promotes the stability of the head in the upswing, that is, just after contact of the head with the ball.

Moreover, in a series of clubs according to the invention, the length of the median rib decreases at the same time as the respective lengths of the branches increase when the loft angle increases.

Hence when the terrain becomes more difficult, with the consequence being a longer contact time for the sole with the ground, causing a lessening of the driving speed, the longer arrow enables good stability for the head in the trajectory that the golfer wishes.

An additional characteristic of the invention is to proceed such that the respective widths of the branches decrease in a series when the loft angle increases.

The surface areas of the median rib and of the arrow are reduced, which brings about a reduction in friction of the sole on the ground.

Another characteristics of the invention is that the value of the angle between the two branches decreases in a series when the loft angle increases.

Consequently, the beginning of the series corresponds to the slight loft angle values associated with great angle values between the branches. An advantage of this arrangement is that the head is accorded good stability in its motion when it is tangent to the ground, due to a great width of the arrow.

Conversely, at the end of the series, the arrow formed by the two branches advantageously become more pointed if the loft angle increases, and the effect of this is to improve the disengagement of the head as it leaves the ground on the upswing of the club after the impact of the head on a ball.

In all cases, the ribs and branches that constitute the relief of the sole serve equally as mechanical reinforcement of the underside of the head and make it possible to limit the deformation caused by external forces applied when impacts or other phenomena occur.

In addition, to reduce the friction of the head that touches the ground, the thicknesses of the ribs or branches increase in a series of clubs relative to the external surface area of the side of the head, while the loft angle increases.

Another characteristic of the invention is that the radius of curvature of the attack edge decreases in a series of clubs when the loft angle increases. This reduction of the radius translates concretely in the series into a more-markedly rounded form and a reduction in the frontal surface area of the head when the loft angle increases. Hence at the beginning of the series, the slight loft angle is advantageously associated with quite a large radius of curvature of the attack edge, which accords good stability to the head and increases the striking area. Then, in proportion to the increase in the loft angle, the passage of the head along the ground in difficult terrain is made easier.

BRIEF DESCRIPTION OF THE DRAWINGS

Other characteristics and advantages of the invention will become apparent from the ensuing description taken in conjunction with the accompanying drawings, in which.

DETAILED DESCRIPTION OF THE PREFERRED EMBODIMENTS

Figure 1:
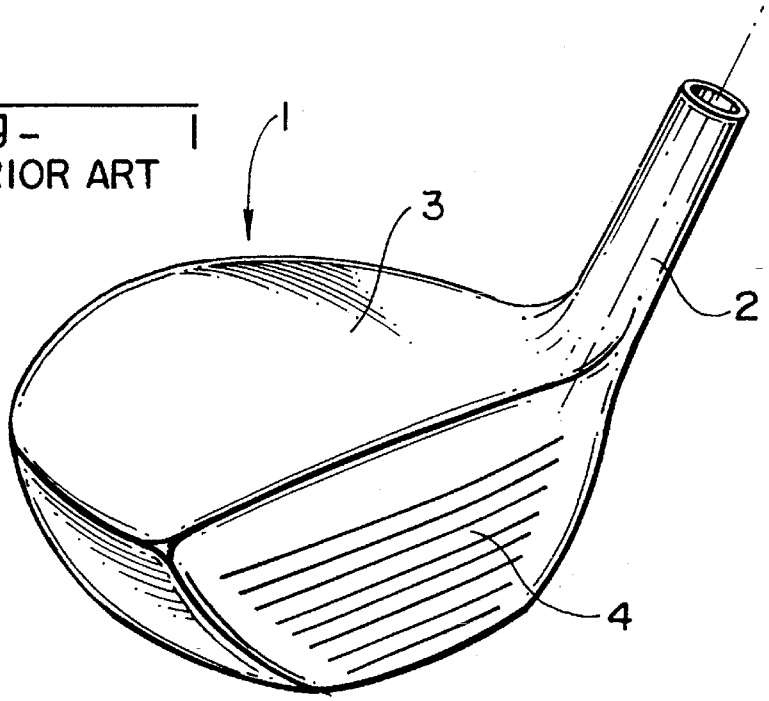
Fig. 1 PRIOR ART
FIG. 1 is a perspective view of a conventional head.

FIG. 1 shows a head 1 solidly joined to a hosel end 2, and provided in particular with a top face 3 and a driving face 4.

Figure 2:
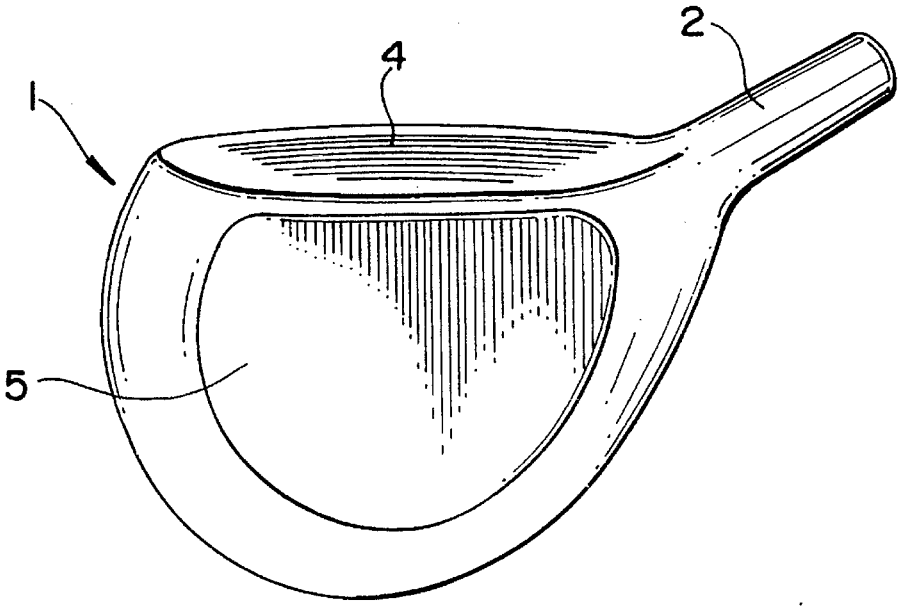
Fig. 2 PRIOR ART
FIG. 2 is a perspective view of a head similar to that of FIG. 1 but from another angle.

The head 1 is also shown in FIG. 2, from a different angle, and has a face 5 on the underside of the head, which is called the bottom face or sole.

This face 5 is conventional and has the appearance of a shell of rounded shape.

Figure 3:
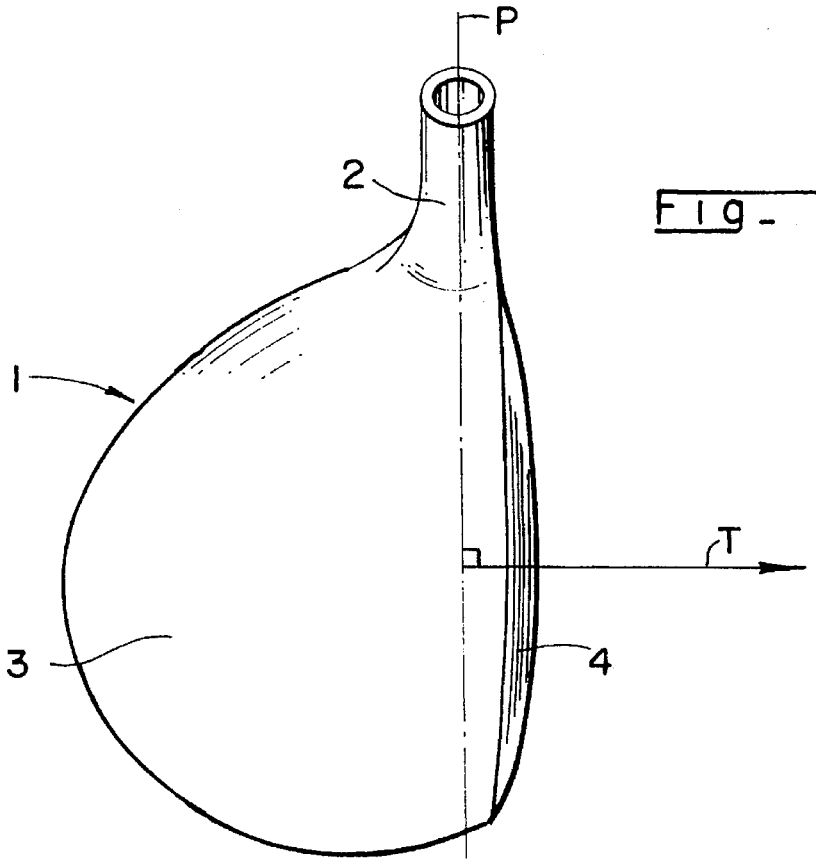
FIG. 3, which is a plan view of a golf club head, shows a vertical reference plane and a driving line.

The identification of these various parts of the head makes it possible to define a reference plane and a reference line, which are shown for example in FIG. 3. A vertical plane P that contains the axis of the rectilinear hosel of the club is perpendicular to a driving line T. The driving line T is a horizontal imaginary line that passes through the geometric center of the driving face 4 and is oriented toward the vertical intangible axis of the targeted hole.

Figure 4:
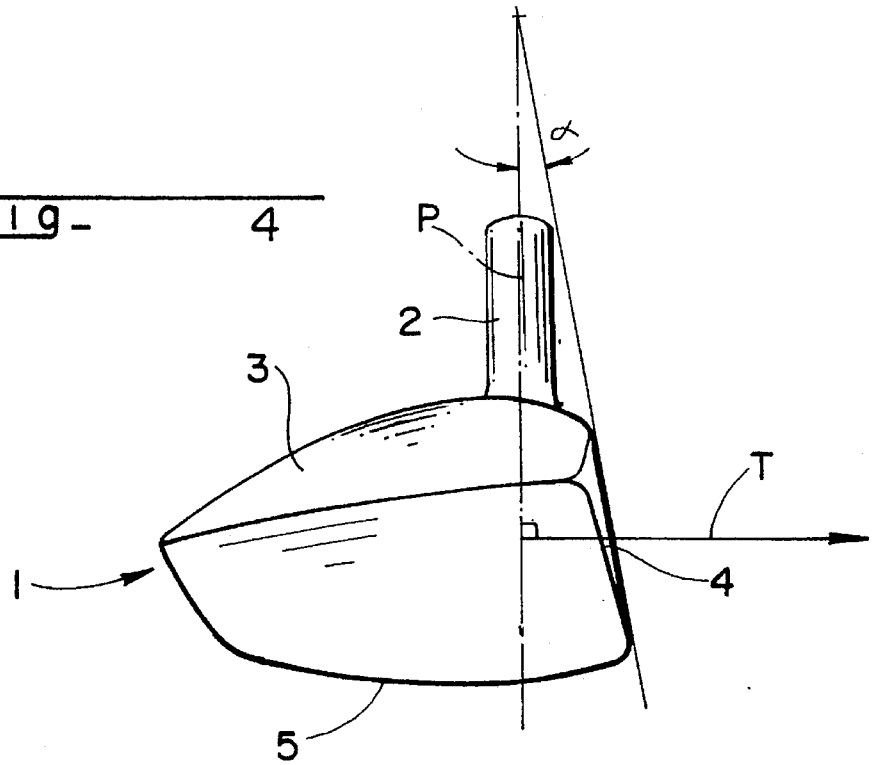
FIG. 4 is a side view of a golf club head and illustrates the loft angle.

This plane P and the line T correspond to the ideal position of the head when the golfer aims his club before hitting a ball. Under these conditions, it is possible to define an angle a, called the loft angle, shown in FIG. 4.

The loft angle is the angle formed between the above-defined plane P and a straight line, located in a vertical plane, that is tangent to the driving face 4 at its geometric center. The usual values for the loft angle are between 0 and several tens of degrees.

In practice, a golfer will choose heads whose loft angle varies from 5 to 15½ in smooth zones that are easy to play, and heads with a more elevated loft angle if the terrain becomes difficult because of obstacles, dirt, sand or other difficulties.

In general, the loft angle chosen increases along a fairway, except for the final part or green.

In parallel fashion, playing conditions increase in difficulty along the fairway, particularly because of friction of the sole 5 with the ground, and this friction is increasingly pronounced the less smooth the terrain becomes.

The invention proposes a solution to this problem, with a series of clubs having the particular sole, various examples of which are shown in the drawings.

Figure 5:
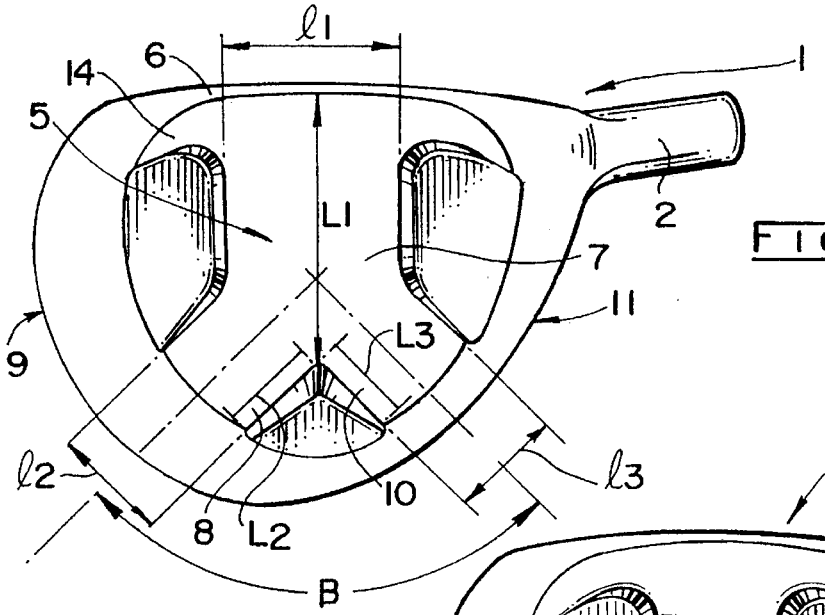
FIG. 5 is a view from below of a golf club head according to the invention, substantially corresponding to a driver.

According to the invention, the first club used on a fairway is a driver or 1-wood of slight loft angle, whose sole is shown in FIG. 5.

Next, different woods, numbered in increasing order beginning with the number 1, are used. The loft angle is increasingly large, the higher the number of the wood.

Figure 6:
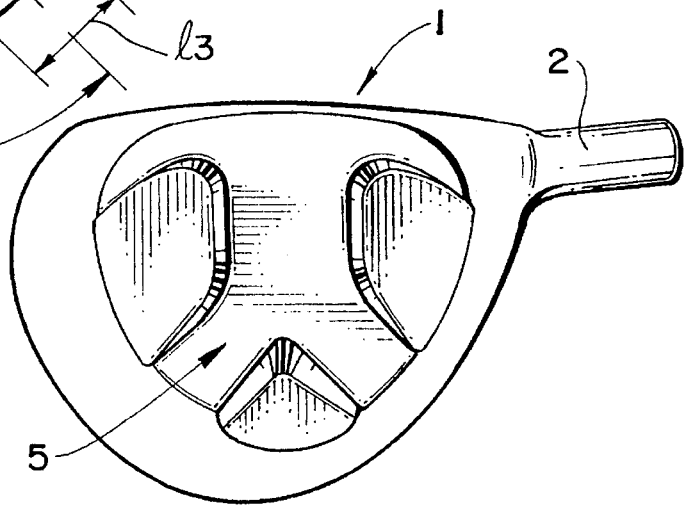
FIG. 6 is a view from below of a golf club head according to the invention, substantially corresponding to a 3-wood.
Figure 7:
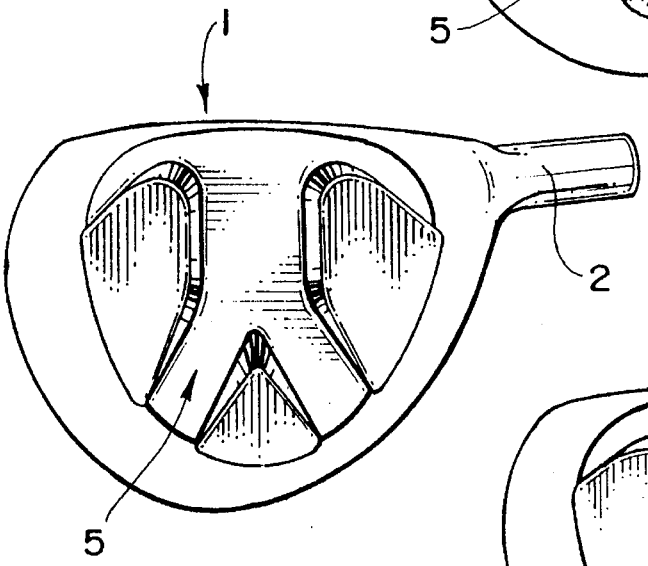
FIG. 7 is a view from below of a golf club head according to the invention, substantially corresponding to a 5-wood.
Figure 8:
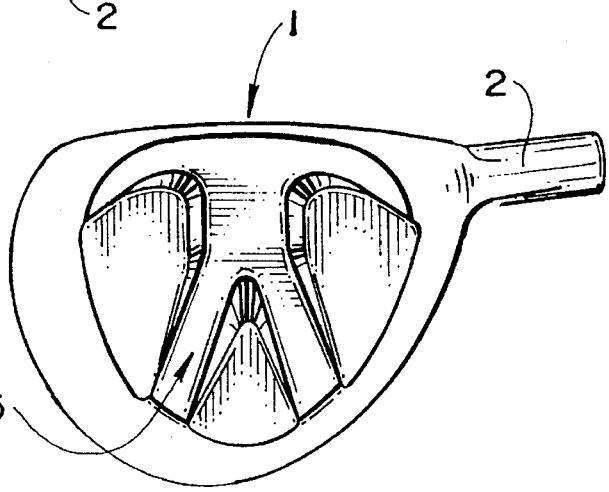
FIG. 8 is a view from below of a golf club head according to the invention, substantially corresponding to a 7-wood.

Various soles shown in FIGS. 6, 7 and 8 correspond successively to a 3-wood, 5-wood and 7-wood.

Loft angle values as a function of the wood number are given by way of non-limiting example.

| Wood number | 3 | 5 | 7 |
|---|---|---|---|
| Loft angle in degrees | 15 | 20 | 23 |

The particular features and advantages of the invention will be better understood from the reference numerals that appear in all of FIGS. 5, 6, 7 and 8.

An attack edge 6 is formed at the intersection of the sole 5 with the front face 4. A median rib 7 of width l1 and length L1 crosses the sole 5 in a substantially central zone from the front to the rear of the head. A branch 8 of width 12 and l2 extends the median rib 7 substantially toward one side of the head, which is called the toe 9.

A branch 10 of width l3 and length l3 extends the median rib 7 substantially toward a side of the head called the heel 11.

The branches 8 and 10 are substantially rectilinear ribs that between them form an angle B other than zero.

Values for widths, lengths and angle B as a function of the loft angle are given as a non-limiting example. The widths and lengths are in millimeters, the values for angles are in degrees.

| LOFT | l1 | L1 | l2 | L2 | l3 | L3 | β |
|---|---|---|---|---|---|---|---|
| 12 | 34 | 48 | 21.5 | 36 | 21.5 | 36 | 73 |
| 17 | 24.5 | 40 | 15 | 38 | 15 | 38 | 60 |
| 21 | 18.5 | 36 | 12 | 40 | 12 | 40 | 55 |

As shown successively by the shapes of the soles in FIGS. 5, 6, 7 and 8, the invention consists of reducing certain dimensions and increasing others, in proportion to how much the loft angle increases in the series.

Hence when the loft angle α increases, the width l1, l2, l3, the length L1 and the angle β decrease, on the one hand, and the length L2, L3 and thicknesses of all the branches and ribs increase, on the other.

It follows that the sole 5 of a head offers less and less resistance to friction when it is tangent to the ground because the contact surface area of the reliefs decreases when the loft angle increases. In this case, it also follows that the head 1 has better penetration into the ground due to the increases in these thicknesses, which bring about a reduction in the depth of passage of the head.

Another advantage is better disengagement of the head when the club rises after impact, since the angle β formed between the branches 8 and 10 decreases when the loft angle increases, to form an increasingly fine arrow that will slip through better in difficult terrain.

Figure 9:
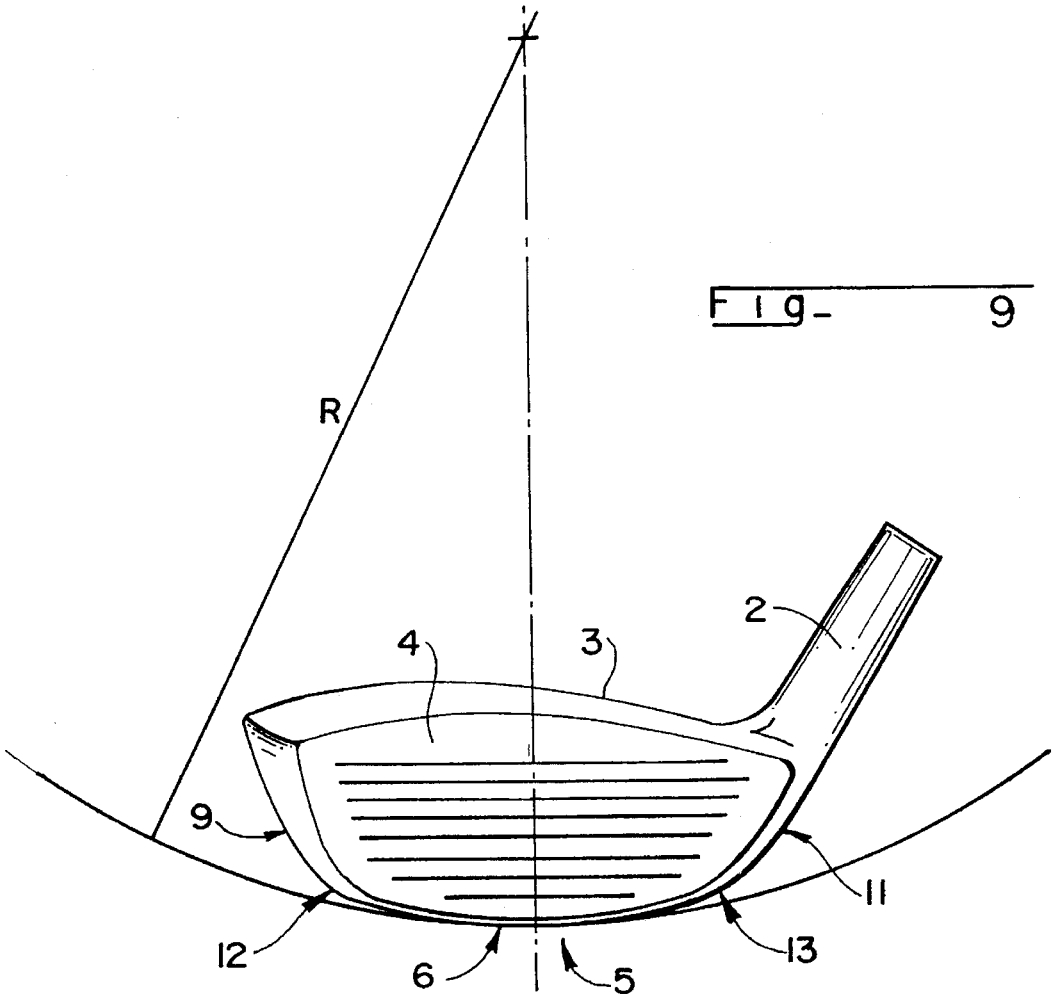
FIG. 9 is a front view of a golf club head showing the driving face and illustrating the radius of curvature of the attack edge.

As to the penetration of the sole 5 in the ground, it is facilitated since the main radius of curvature R of the attack edge 6, shown in FIG. 9, has a value that decreases when the loft angle increases.

Hence the front surface area of the head decreases at the same time as the ends 12 and 13 of the attack edge 6, that is, the toe side and the heel side respectively, are raised relative to the level of the attack edge 6.

Figure 10:
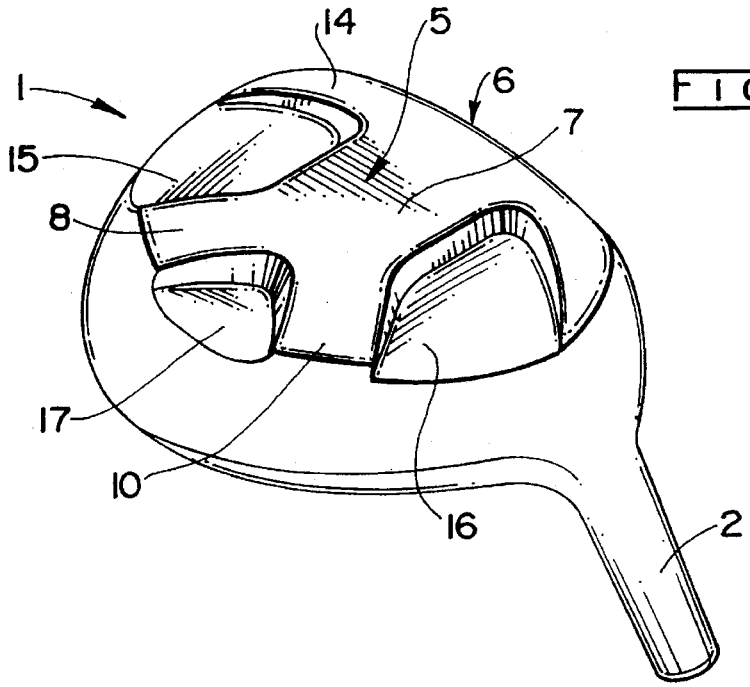
FIG. 10 is a perspective view of the underside of a head according to the invention, where the ribs and branches are an integral part of the sole.

To further facilitate the swing, in which the head strikes a ball, an edge rib 14, shown for example in FIG. 10, makes it possible to create lateral surfaces 15 and 16. These surfaces, partially defined by the thickness of the edge rib 14 and by the thickness of the median rib 7, form notches that contribute both to reducing the surface area in contact with the ground and facilitating the lateral ejection of soil particles via the branches 8 and 10.

In the same spirit, the rear surface 17 is a notch in the hole 5 that is defined in part by the thicknesses of the branches 8 and 10, which facilitates the evacuation of dirt particles and reduces friction of the head on the ground in the upswing motion of the club.

Several embodiments of a series of heads according to the invention are possible. FIG. 10 is a perspective view of a monobloc head, that is, one in which the relief made up by the various thicknesses is integral with the remainder of the head. By way of non-limiting example, this may be a hollow metal head made of two separate parts that are molded and then joined together, for instance by welding.

These two parts may be a main hollow body, obtained by the method of lost wax molding, known to one skilled in the art, and a wall that serves to close the head after welding.

Figure 11:
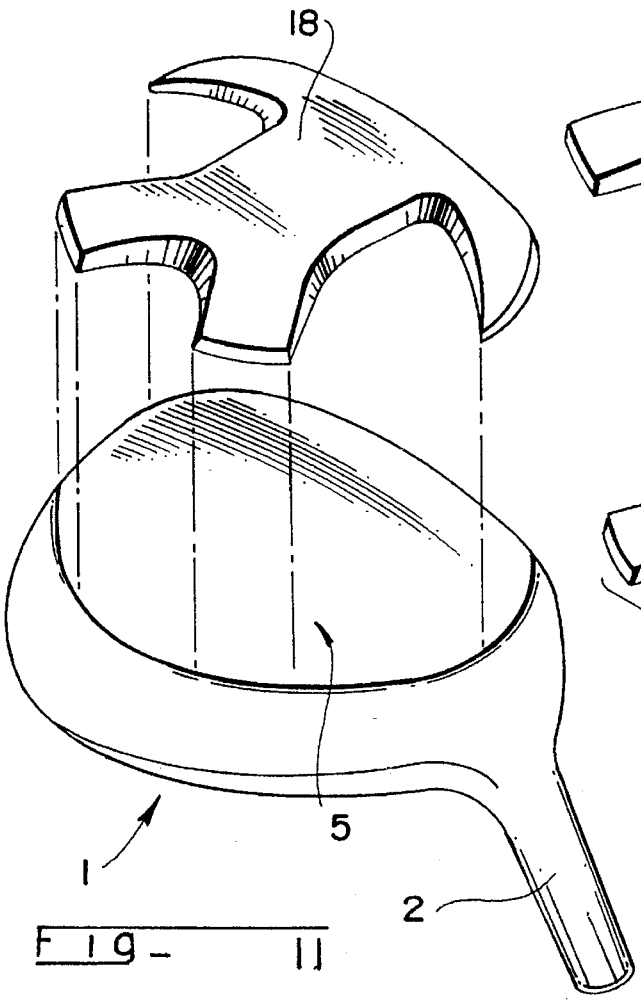
FIG. 11 is a perspective view of the underside of a head showing the ribs and branches connected to the sole.

FIG. 11 shows a head 1 whose sole 5 is smooth and to which a monobloc relief 18 is connected that is solidly joined to the head 1 by any suitable means, such as adhesive bonding, riveting, screwing, welding, or other.

Figure 12:
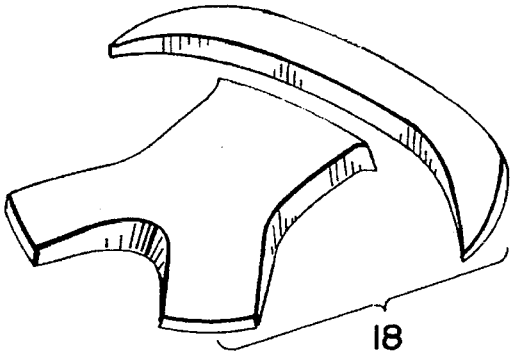
FIG. 12 is an exemplary relief made in more than one piece.
Figure 13:
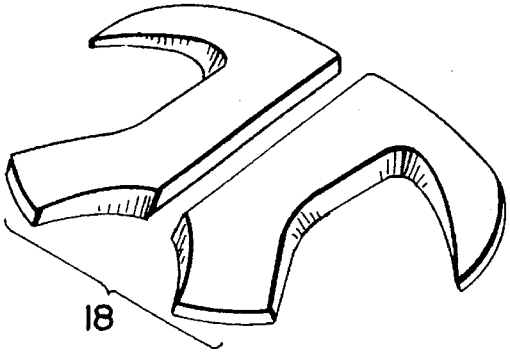
FIG. 13 is another example of a relief made in more than one piece.

FIGS. 12 and 13 are examples of reliefs 18, to be joined to the sole 5 of a head 1, which are in several pieces.

Advantageously, the constituent piece or pieces of the relief 18 may be made of any suitable material in such a way as to improve the wear resistance, resiliency, and friction, or to enable a distribution of the specific masses.

Hence this piece or pieces may be heavier or lighter than the material of which the faces of the head are made.

Figure 14:
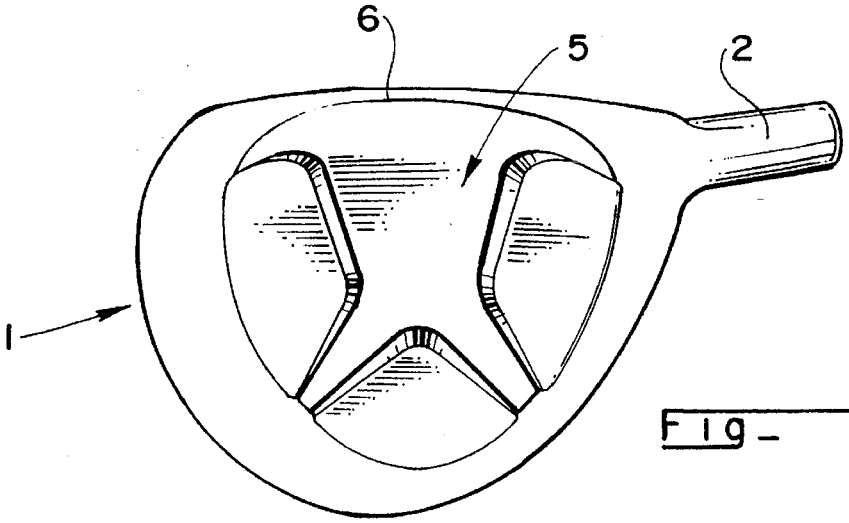
FIG. 14 is an example of a sole according to the invention, in which the reliefs are made with ribs having non-parallel edges and a non-constant width.

FIG. 14 shows one of numerous variants of possible shapes for each head, characterized in that the respective widths of the ribs and branches are not constant.

Generally, the series of clubs according to the invention is characterized in that the volume of each head of this series is moreover greater than the volume of a traditional head with an equivalent loft angle.

As a non-limiting example, the invention preferably utilizes a "driver" or 1-wood of which the volume is equal to or greater than 170 $cm^3$, whereas the conventional "driver" most often has a volume that is close to 150 to 160 $cm^3$.

The instant application is based upon French patent application 93.13680, filed on Nov. 12, 1993, the disclosure of which is hereby expressly incorporated by reference thereto and the priority of which is hereby claimed.

Finally, it is to be understood that the invention is not limited to the specific embodiments thus described and that it includes any technical equivalents that can be encompassed by the scope of the following claims.

What is claimed is:

1. A series of golf clubs, each of said clubs comprising:

a hosel extending along a vertical plane (P) positioned perpendicular to a driving line (T); and a head;

where in:

said head comprising a plurality of faces, said plurality of faces comprising:

a bottom face for resting upon the ground; and a front face inclined by a loft angle (α) with respect to said vertical plane (P);

said head further comprising an attack edge formed by an intersection of said bottom face and said front face;

said bottom face comprising at least one median rib in relief, said median rib being positioned substantially perpendicularly to said attack edge; and said median rib has a predeterminate width (l1) for each of said clubs within said series, said predeterminate width of said median rib decreasing as said loft angle (α) increases within said series.

2. A series of golf clubs according to claim 1, wherein:

said bottom face further comprises an edge rib extending along and adjacent to said attack edge, said edge rib being substantially perpendicular to said median rib.

3. A series of golf clubs according to claim 1, wherein:

said median rib is extended by two branches in a direction away from said attack edge, said two branches diverging from each other to form an angle (β) greater than zero.

4. A series of golf clubs according to claim 3, wherein:

said median rib has a length (L1) which decreases and said two branches have respective lengths (L2, L3) which decrease as said loft angle (α) increases within said series.

5. A series of golf clubs according to claim 3, wherein:

said two branches have respective widths (l2, l3) which decrease as said loft angle (α) increases within said series.

6. A series of golf clubs according to claim 3, wherein:

said angle (β) between said two branches decreases as said loft angle (α) increases within said series.

7. A series of golf clubs according to claim 3, wherein:

said median rib has a thickness which increases as said loft angle (α) increases within said series.

8. A series of golf clubs according to claim 7, wherein:

said two branches have respective thicknesses which increase as said loft angle (α) increases within said series.

9. A series of golf clubs according to claim 1, wherein:

said attack edge has a radius of curvature (R) which decreases as said loft angle (α) increases within said series.

10. A series of golf clubs according to claim 3, wherein:

said bottom face is a part of a sole; and said median rib and said two branches are unitary with said sole.

11. A series of golf clubs according to claim 3, wherein:

said median rib and said two branches are separate from and affixed to said bottom face.

12. A series of golf clubs according to claim 11, wherein:

said median rib and said two branches are comprised of at least one piece of material.

13. A series of golf clubs according to claim 1, wherein:

each said head of said series of golf clubs has a volume greater than a volume of a conventional head with an equivalent loft angle (α).

14. A series of golf clubs according to claim 2, wherein:

said median rib is extended by two branches in a direction away from said attack edge, said two branches diverging from each other to form an angle (β) greater than zero.

15. A series of golf clubs according to claim 14, wherein:

said median rib has a length (L1) which decreases and said two branches have respective lengths (L2, L3) which decrease as said loft angle (α) increases within said series.

16. A series of golf clubs according to claim 14, wherein:

said two branches have respective widths (l2, l3) which decrease as said loft angle (α) increases within said series.

17. A series of golf clubs according to claim 14, wherein:

said angle (β) between said two branches decreases as said loft angle (α) increases within said series.

18. A series of golf clubs according to claim 14, wherein:

said median rib and said edge rib have respective thicknesses which increase as said loft angle (α) increases within said series.

19. A series of golf clubs according to claim 18, wherein:

said two branches have respective thicknesses which increase as said loft angle (α) increases within said series.

20. A series of golf clubs according to claim 14, wherein:

said bottom face is a part of a sole; and said median rib, said edge rib, and said two branches are unitary with said sole.

21. A series of golf clubs according to claim 14, wherein:

said median rib, said edge rib, and said two branches are separate from and affixed to said bottom face.

22. A series of golf clubs according to claim 21, wherein:

said median rib, said edge rib, and said two branches are comprised of at least one piece of material.

* * * * *